US011208897B2

(12) United States Patent
Lin et al.

(10) Patent No.: US 11,208,897 B2
(45) Date of Patent: Dec. 28, 2021

(54) HEAT DISSIPATION FAN

(71) Applicant: Acer Incorporated, New Taipei (TW)

(72) Inventors: Kuang-Hua Lin, New Taipei (TW); Cheng-Wen Hsieh, New Taipei (TW); Wen-Neng Liao, New Taipei (TW)

(73) Assignee: Acer Incorporated, New Taipei (TW)

( * ) Notice: Subject to any disclaimer, the term of this patent is extended or adjusted under 35 U.S.C. 154(b) by 71 days.

(21) Appl. No.: 16/528,647

(22) Filed: Aug. 1, 2019

(65) Prior Publication Data

US 2020/0040738 A1 Feb. 6, 2020

(30) Foreign Application Priority Data

Aug. 2, 2018 (TW) ..... 107126928

(51) Int. Cl.

| | |
|---|---|
| ***F01D 5/14*** | (2006.01) |
| ***F04D 19/00*** | (2006.01) |
| ***F04D 29/54*** | (2006.01) |
| *F04D 29/38* | (2006.01) |
| *F04D 29/18* | (2006.01) |

(52) U.S. Cl.

CPC ..... *F01D 5/146* (2013.01); *F04D 19/002* (2013.01); *F04D 29/544* (2013.01); *F04D 29/181* (2013.01); *F04D 29/384* (2013.01)

(58) Field of Classification Search

CPC ..... F01D 5/146; F04D 19/002; F04D 29/181; F04D 29/384; F04D 29/544; F04D 29/325; H05K 7/20172

See application file for complete search history.

(56) References Cited

U.S. PATENT DOCUMENTS

| | | | | |
|---|---|---|---|---|
| 3,075,743 | A * | 1/1963 | Sheets | F01D 5/146 415/220 |
| 3,195,807 | A * | 7/1965 | Sheets | F01D 5/146 415/220 |
| 3,244,400 | A * | 4/1966 | Selden | F16H 41/26 416/231 R |
| 3,867,062 | A | 2/1975 | Troller | |
| 5,885,058 | A | 3/1999 | Vilagines et al. | |
| 6,099,249 | A * | 8/2000 | Hashimoto | F01D 9/041 415/199.4 |
| 7,025,569 | B2 * | 4/2006 | Chang | F04D 29/38 416/183 |
| 8,668,436 | B2 * | 3/2014 | Oishi | F04D 29/324 415/90 |
| 9,453,423 | B2 * | 9/2016 | Gomez | F04D 29/544 |
| 9,470,091 | B2 * | 10/2016 | Gomez | F01D 5/146 |
| 9,506,360 | B2 * | 11/2016 | Wunderer | F04D 29/544 |
| 9,765,788 | B2 * | 9/2017 | Dybenko | F04D 29/162 |

(Continued)

FOREIGN PATENT DOCUMENTS

| | | |
|---|---|---|
| CN | 2531148 | 1/2003 |
| CN | 202746288 | 2/2013 |

(Continued)

*Primary Examiner* — Jesse S Bogue
(74) *Attorney, Agent, or Firm* — JCIPRNET

(57) ABSTRACT

A heat dissipation fan including a hub and a plurality of fan assemblies are provided. The fan assemblies are disposed around the hub, and each of the fan assemblies includes at least two blades. A runner is formed between the at least two blades. A width of the runner gradually reduces along a rotating axis of the hub.

10 Claims, 4 Drawing Sheets

(56) References Cited

U.S. PATENT DOCUMENTS

| | | | | |
|---|---|---|---|---|
| 9,938,984 | B2 * | 4/2018 | DiPietro, Jr. | F04D 29/329 |
| 10,669,854 | B2 * | 6/2020 | Duong | F01D 5/04 |
| 2005/0063825 | A1 | 3/2005 | Yang | |
| 2005/0175448 | A1 * | 8/2005 | Jacobsson | F04D 29/324<br>415/194 |
| 2008/0247868 | A1 * | 10/2008 | Lan | F04D 29/384<br>415/182.1 |
| 2012/0148396 | A1 * | 6/2012 | Guemmer | F01D 5/146<br>415/208.2 |
| 2013/0209259 | A1 * | 8/2013 | Gomez | F04D 29/563<br>416/200 A |
| 2017/0114796 | A1 * | 4/2017 | DiPietro, Jr. | F04D 29/544 |

FOREIGN PATENT DOCUMENTS

| | | |
|---|---|---|
| CN | 104033422 | 9/2014 |
| CN | 205036634 | 2/2016 |
| CN | 205225853 | 5/2016 |
| DE | 102007063023 | 5/2009 |
| TW | I227109 | 1/2005 |
| TW | 200738112 | 10/2007 |
| TW | M413898 | 10/2011 |

* cited by examiner

HEAT DISSIPATION FAN

CROSS-REFERENCE TO RELATED APPLICATION

This application claims the priority benefit of Taiwan application serial no. 107126928, filed on Aug. 2, 2018. The entirety of the above-mentioned patent application is hereby incorporated by reference herein and made a part of this specification.

BACKGROUND

Technical Field

The invention relates to a heat dissipation fan.

Description of Related Art

The existing axial fans are widely applied in computer hosts to dissipate heat. Nevertheless, as development of performance of hosts used in personal computers and servers speeds up, a large amount of waste heat is correspondingly generated by computer hosts featuring high performance. Hence, how a fan capable of generating a large amount of airflow and delivering a favorable heat dissipation effect can be manufactured is an important issue, so as to prevent accumulation of waste heat which may affect operation of a host.

In addition, when an existing axial fan rotates, airflow flows along the surface of the blades, but the flowing speed of airflow flowing on the surface of the blades gradually decreases as affected by the viscous force. Finally, airflow is detached from the surface of the blades, and a vortex flow is thereby formed. The amount of airflow flowing through the fan is lowered when the vortex flow is formed, and moreover, the vortex flow may also lead to noises.

SUMMARY

The invention provides a heat dissipation fan capable of effectively increasing an amount of airflow and preventing a vortex flow from being generated.

A heat dissipation fan provided by an embodiment of the invention includes a hub and a plurality of fan assemblies. The fan assemblies are disposed around the hub, and each of the fan assemblies includes at least two blades. A runner is formed between the at least two blades, and a width of the runner gradually reduces along a rotating axis of the hub.

To sum up, the heat dissipation fan provided by the embodiments of the invention includes the fan assemblies disposed around the hub, and each of the fan assemblies includes at least two blades. Further, since the runner between the at least two blades is tapered along the rotating axis of the hub, when the heat dissipation fan rotates and after air is directed into the runner between the at least two blades, the vortex flow is less likely to be generated through the tapered runner and that a greater amount of airflow is obtained. Therefore, the heat dissipation effect of the heat dissipation fan is enhanced. In addition, as the vortex flow is less likely to be formed, air is less likely to resonate, so that less noise is generated.

To make the aforementioned more comprehensible, several embodiments accompanied with drawings are described in detail as follows.

BRIEF DESCRIPTION OF THE DRAWINGS

The accompanying drawings are included to provide a further understanding of the disclosure, and are incorporated in and constitute a part of this specification. The drawings illustrate exemplary embodiments of the disclosure and, together with the description, serve to explain the principles of the disclosure.

DESCRIPTION OF THE EMBODIMENTS

Figure 1:
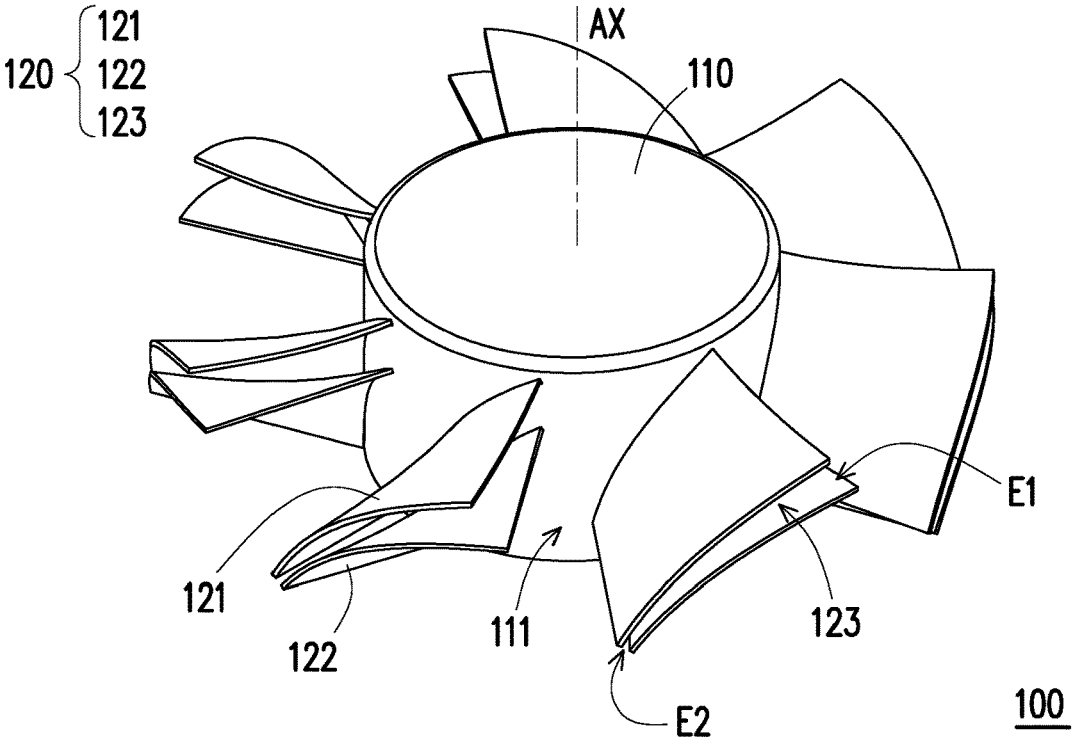
FIG. 1 is a schematic three-dimensional view of a heat dissipation fan according to an embodiment of the invention.
Figure 2:
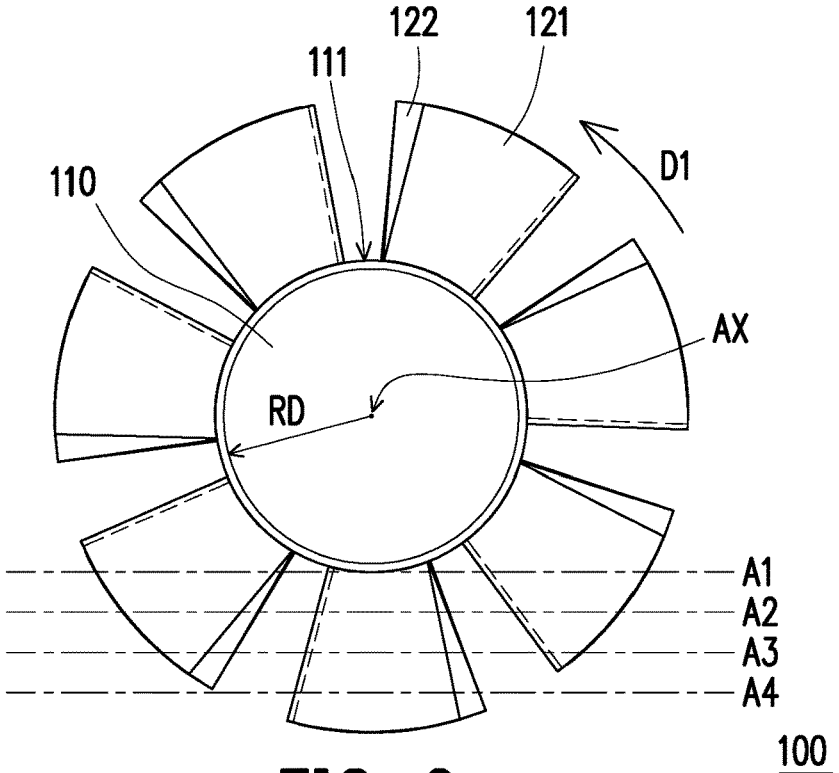
FIG. 2 is a top view illustrating the heat dissipation fan of FIG. 1.
Figure 3A:
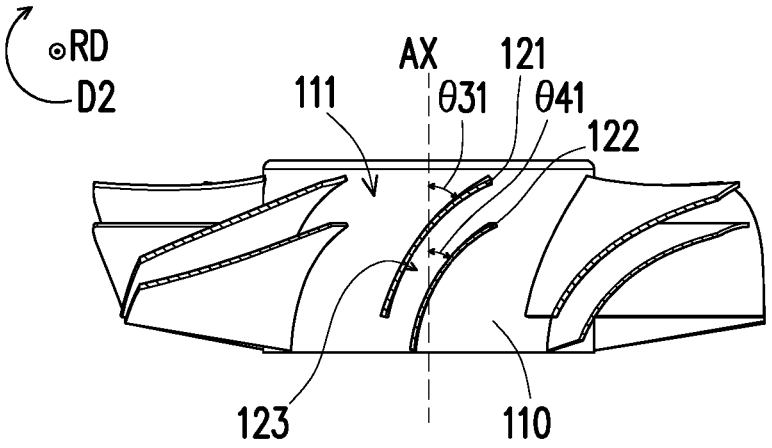
FIG. 3A to FIG. 3D are local cross-sectional views illustrating different portions of the heat dissipation fan.
Figure 3B:
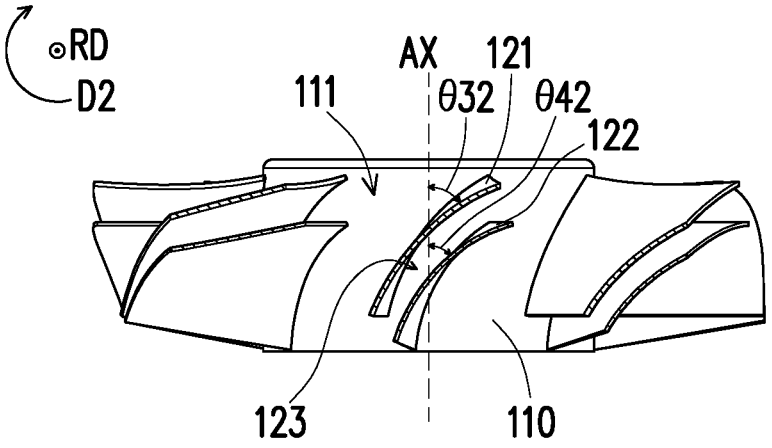
Figure 3C:
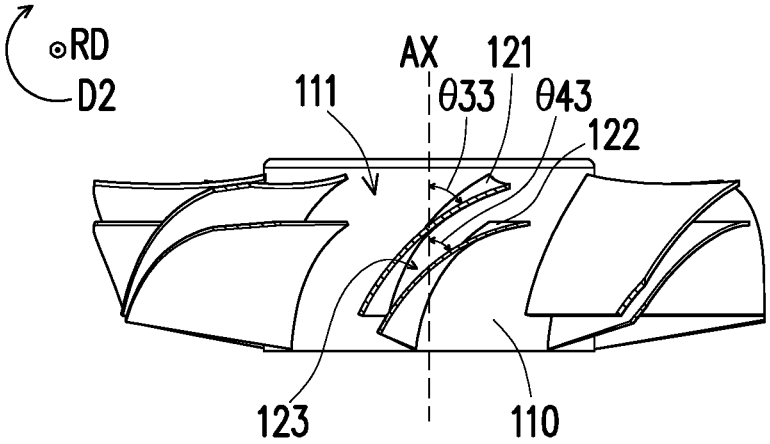
Figure 3D:
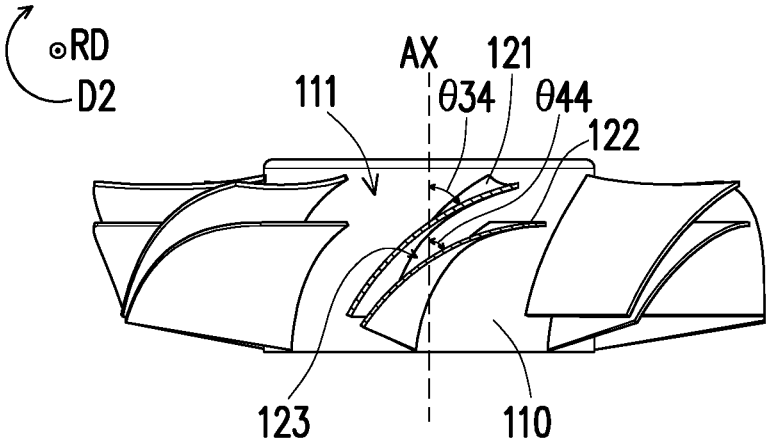

FIG. 1 is a schematic three-dimensional view of a heat dissipation fan according to an embodiment of the invention and is viewed from a bottom view. FIG. 2 is a top view illustrating the heat dissipation fan of FIG. 1. FIG. 3A to FIG. 3D are local cross-sectional views illustrating different portions of the heat dissipation fan, and the different cross-sectional lines A1 to A4 in FIG. 2 respectively correspond to FIG. 3A to FIG. 3D.

With reference to FIG. 1 and FIG. 2 first, in this embodiment, a heat dissipation fan 100 is suitable to be disposed in a computer host (e.g., a notebook computer, a personal computer, or a large server) to perform heat dissipation on electronic devices in the computer host, so as to prevent waste heat from being accumulated so the computer host is prevented from being overheated. Herein, the heat dissipation fan 100 is, for example, an axial fan and includes a hub 110 and a plurality of fan assemblies 120. The fan assemblies 120 are disposed around the hub 110. The hub 110 is controlled by a motor (not shown) to drive each of the fan assemblies 120 to rotate around a rotating axis AX, so as to direct air 200 to flow into each of the fan assemblies 120.

In this embodiment, the hub 110 has a side surface 111 orthogonal to a radial direction RD of the hub 110. The fan assemblies 120 are separately disposed on the side surface 111 of the hub 110, and the fan assemblies 120 are disposed in an equidistant manner. Each of the fan assemblies 120 includes at least two blades. A runner is formed between the at least two blades. Herein, a runner 123 formed between a first blade 121 and a second blade 122 corresponding to each other is taken for example. Note that a width of the runner 123 gradually reduces in the radial direction RD and in an extending direction of the first blade 121 and the second blade 122 away from the hub 110 and gradually reduces along the rotating axis AX as well.

Figure 4A:
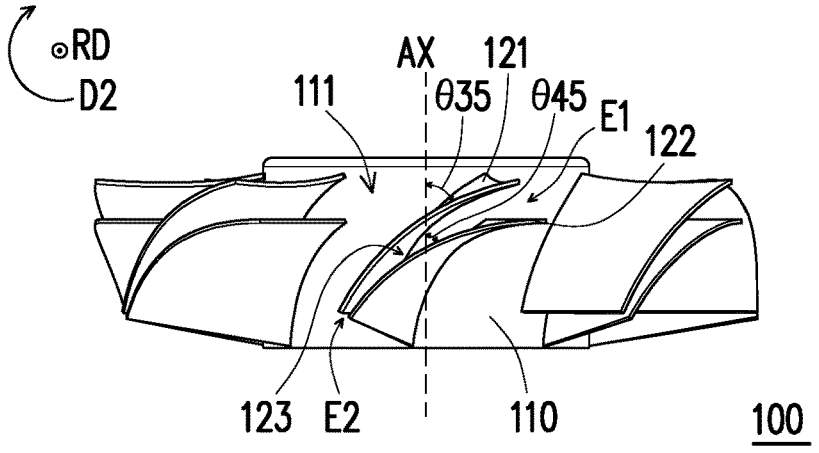
FIG. 4A is a side view of the heat dissipation fan of FIG. 1.

FIG. 3A to FIG. 3D are local cross-sectional views illustrating different portions of the heat dissipation fan. FIG. 4A is a side view of the heat dissipation fan of FIG. 1. With reference to FIG. 3A to FIG. 3D and FIG. 4A and comparing to FIG. 2, further, the first blade 121 and the second blade 122 are bent in a rotating direction D1 of the heat dissipation fan 100. That is, bending of the first blade 121 and the second blade 122 corresponds to the rotating direction D1, as such, air may easily enter into the runner 123 of the heat dissipation fan 100 from top to bottom. Moreover, a blade contour of the first blade 121 and a blade contour of the second blade 122 are different, that is, a degree of bending of the first blade 121 is different from a degree of bending of the second blade 122.

Specifically, FIG. 3A to FIG. 3D illustrate cross-sectional views in the radial direction RD away from the hub 110 taken along the different cross-sectional lines A1 to A4 shown in FIG. 2. Hence, from FIG. 3A to FIG. 3D, it can clearly be seen that in each of the fan assemblies 120, the first blade 121 and the second blade 122 corresponding to each other are twisted in the radial direction RD of the hub 110. To be more specifically, in the radial direction RD, the first blade 121 is twisted in a twisting direction D2 when moving away from the hub 110 so that different included angles θ31 to θ34 relative to the rotating axis AX are formed. Similarly, the second blade 122 is twisted in the twisting direction D2 when moving away from the hub 110 so that different included angles θ41 to θ44 relative to the rotating axis AX are formed. More importantly, a degree of gradual increase in the included angles between the first blade 121 and the rotating axis AX is different from a degree of gradual increase in the included angles between the second blade 122 and the rotating axis AX.

That is, in this embodiment, in the same fan assembly 120, the first blade 121 and the second blade 122 are distributed in the radial direction RD acting as an axis and are structurally twisted in the twisting direction D2. Moreover, with reference to FIG. 3A to FIG. 3D and FIG. 4, it can be clearly seen that the rotating axis AX as a benchmark, the degree of increase in the included angles between the first blade 121 and the rotating axis AX is substantially greater than the degree of increase in the included angles between the second blade 122 and the rotating axis AX. That is, the degree of increase in the included angles θ41 to θ45 is greater than the degree of increase in the included angles θ31 to θ35. In this way, the runner 123 is gradually tapered from top to bottom substantially along the rotating axis AX and is also gradually tapered in the radial direction RD of the hub 110, and the runner 123 may also be viewed as being gradually tapered in a reverse direction of the rotating direction D1.

Figure 4B:
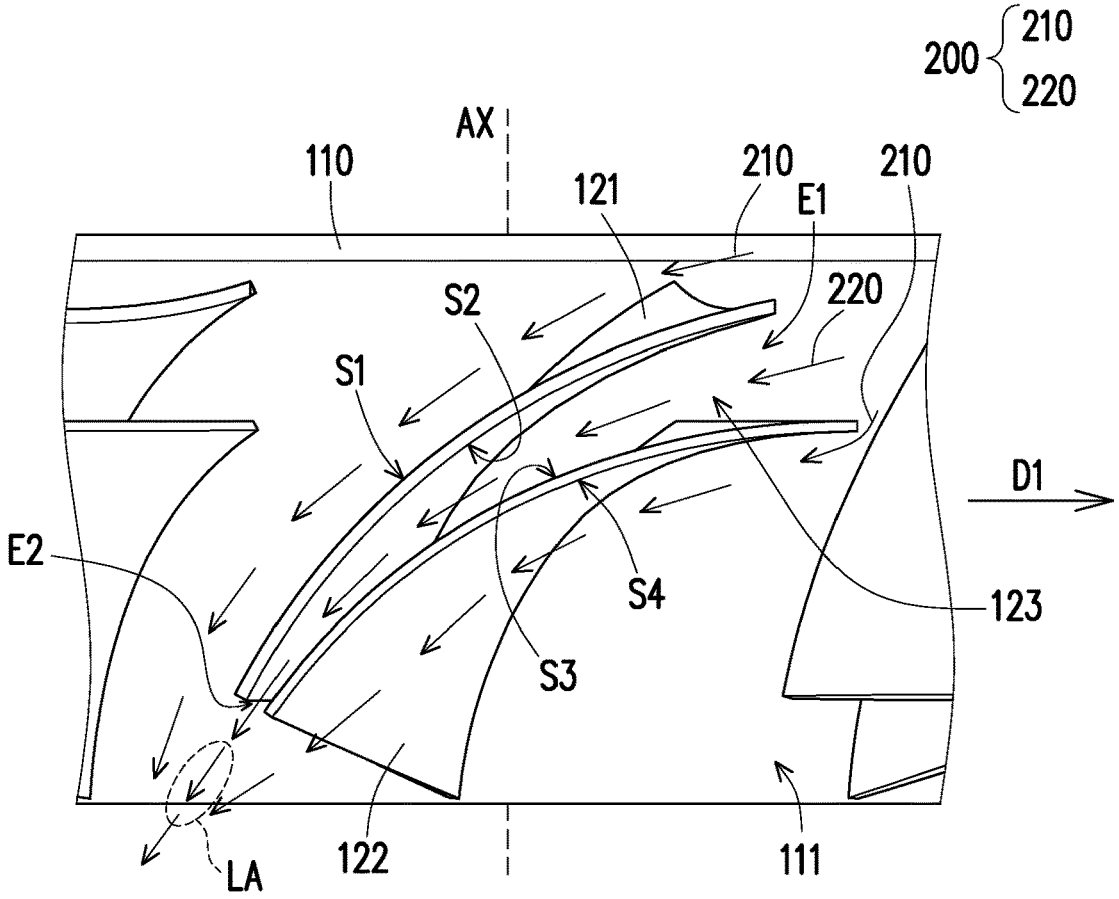
FIG. 4B is a local enlarged view of FIG. 4A.

FIG. 4B is a local enlarged view of FIG. 4A. With reference to FIG. 4A and FIG. 4B together, as described above, in this embodiment, one side of the runner 123 close to the side surface 111 of the hub 110 is an inlet E1, and another side of the runner 123 away from the side surface 111 of the hub 110 is an outlet E2. The width of the runner 123 gradually reduces from the inlet E1 towards the outlet E2. When the hub 110 is controlled by the motor to drive each of the fan assemblies 120 to rotate in the rotating direction D1, the external air 200 flows along the rotating axis AX1 towards the hub 110.

Specifically, part of the air 200 flows along a first upper surface S1 of the first blade 121 and a second lower surface S4 of the second blade 122 two form two external air streams 210. When the two external air streams 210 individually pass through the first upper surface S1 and the second lower surface S4, a flowing speed of the two external air streams 210 slows down as affected by a viscous force. Finally, the two external air streams 210 can not continue to flow along the first upper surface S1 and the second lower surface S4 as the flowing speed slows down, so that the two external air streams 210 are detached from the first blade 121 and the second blade 122 as boundary layer separation occurs.

Nevertheless, another part of the air 200 is directed by the hub 110 to flow in the runner 123 from the inlet E1 to form an internal air stream 220 at the same time. The internal air stream 220 flows along a first lower surface S2 of the first blade 121 and a second upper surface S3 of the second blade 122 and flows out from the outlet E2 of the runner 123. When flowing, as the width of the runner 123 gradually reduces, the internal air stream 220 of the air 200 is pressurized. As such, the internal air stream 220 of the air 200 is pressurized and is ejected from the outlet E2 of the runner 123 to form a low-pressure region LA, and the low-pressure region LA is configured to direct and converge the surrounding air 200. To be specific, since a pressure of the low-pressure region LA is less than a pressure of a peripheral region, the two external air streams 210 which originally are to be detached from the first blade 121 and the second blade 122 are directed. In this way, the internal air stream 220 and the external air streams 210 are combined, and a greater air stream is thereby formed. Hence, a separation flow or a vortex flow is prevented from being formed among the fan assemblies 120.

In this embodiment, a material of the hub 110 is plastic or metal, and a material of the first blade 121 and a material of the second blade 122 are metal. The hub 110 may thereby be bonded to the first blades 121 and the second blades 122 of the fan assemblies 120 through injection molding (when the hub 110 is made of plastic) or pressure casting (when the hub 110 is made of metal). Further, a thickness of each of the first blades 121 and a thickness of each of the second blades 122 are, for example, less than 0.5 mm. Nevertheless, this embodiment is not intended to limit how the hub and the fan assemblies are combined together. In another embodiment that is not shown, engaging structures corresponding to one another are disposed at the hub as well as the fan assemblies, so that the hub and the fan assemblies may be assembled and fixed together through engagement among the engaging structures.

Further, the fan assemblies 120 of this embodiment are made of metal and thus feature favorable extensibility, so that a thickness of the fan assemblies 120 may be further lowered (less than 0.5 mm as described above). In this way, in the heat dissipation fan 110, a number of the first blades 121 and a number of the second blade 122 which can be disposed on the hub 110 are, for example, greater than or equal to 50, and such fan structure is obviously more favorable than a fan structure formed by plastic injection molding based on the related art.

Further, when the blades are made of plastic, the thickness and shape of the blades are subject to greater limitation as limited by the manufacturing process of plastic injection molding and material characteristics, and thus, design of blades of special shapes is difficult to be provided. In this embodiment, since the first blades 121 and the second blades 122 are made of metal, the blade contours featuring greater variations can be adopted for the first blades 121 and the second blades 122 according to needs so as to reduce the thicknesses. In general, a static pressure of the heat dissipation fan 100 increases as a number of the fan assemblies 120 increases. Nevertheless, when the fan assemblies 120 increase in number, the runner 123 decreases in width, as such, an amount of airflow generated when the heat dissipation fan 100 rotates is lowered, and a heat dissipation effect of the heat dissipation fan 100 is thus affected. Therefore, metal is adopted for the first blades 121 and the second blades 122 in this embodiment, and in this way, even if the first blades 121 and the second blades 122 increase in number, the reduced thicknesses of the first blades 121 and the second blades 122 can compensate for the decrease in width of the runner 123. Further, suitable blade numbers (greater than or equal to 50) and suitable blade thicknesses (less than 0.5 mm) are optimally calculated, as such, both the static pressure as well as the amount of airflow are increased.

In view of the foregoing, in the heat dissipation fan provided by the invention, each of the fan assemblies includes a first blade and a second blade. As the first blade and the second blade are separately disposed, the runner which is gradually tapered outwardly is formed, so as to direct airflow to flow between the first blade and the second blade. As the low-pressure region is formed when air passes through the runner which is gradually tapered, the surrounding air is attracted and converged, so that the vortex flow or the separation flow and the like which may lead to kinetic energy loss is prevented from being generated. In this way, a greater amount of airflow is generated when the heat dissipation fan is operated, and the heat dissipation effect of the heat dissipation fan is thereby increased. Besides, as the vortex flow or the separation flow is less likely to be formed, air is less likely to resonate, so that less noise is generated.

Further, the numbers, thicknesses, and blade contours of the first blades and the second blades are optimally arranged, so that both the static pressure and the amount of airflow generated by the heat dissipation fan are increased.

Although the embodiments are already disclosed as above, these embodiments should not be construed as limitations on the scope of the invention. It will be apparent to those skilled in the art that various modifications and variations can be made to the disclosed embodiments without departing from the scope or spirit of this invention. In view of the foregoing, it is intended that the invention covers modifications and variations provided that they fall within the scope of the following claims and their equivalents.

What is claimed is:

1. A heat dissipation fan, disposed in a computer host to perform heat dissipation on electronic devices in the computer host, comprising:

a hub; and a plurality of fan assemblies, disposed around the hub, each of the fan assemblies comprising at least two blades overlapped along a rotating axis of the hub and from two radially extending edges of the two blades to another two radially extending edges of the two blades, wherein a runner is formed between the at least two blades, and a width of the runner gradually reduces along the rotating axis of the hub between an inlet of the runner and an outlet of the runner, wherein the width is a distance between the at least two blades at corresponding distances along the respective chord, wherein the inlet of the runner is formed by said two radially extending edges, and the outlet of the runner is formed by said another two radially extending edges.

2. The heat dissipation fan as claimed in claim 1, wherein the fan assemblies are radially arranged with respect to the hub, each of the fan assemblies comprises a first blade and a second blade, the first blade and the second blade correspond to each other and are spaced apart by the runner, and each of the corresponding first blade and the second blade is twisted in a radial direction of the hub.

3. The heat dissipation fan as claimed in claim 2, wherein in the radial direction, the first blade is twisted in a twisting direction when moving away from the hub so that different included angles relative to the rotating axis are formed, the second blade is twisted in the twisting direction when moving away from the hub so that different included angles relative to the rotating axis are formed, and a degree of gradual increase in included angles between the first blade and the rotating axis is different from a degree of gradual increase in included angles between the second blade and the rotating axis.

4. The heat dissipation fan as claimed in claim 2, wherein a blade contour of the first blade and a blade contour of the second blade are different, and the state of the twisted first blade is different from the state of the twisted second blade.

5. The heat dissipation fan as claimed in claim 2, wherein a material of the first blade and a material of the second blade are metal.

6. The heat dissipation fan as claimed in claim 1, wherein the heat dissipation fan is an axial fan, air flows in from an inlet of the runner and flows out from an outlet of the runner, and air is pressurized as the runner is gradually tapered.

7. The heat dissipation fan as claimed in claim 6, wherein air is pressurized and is ejected from the outlet to form a low-pressure region, and the low-pressure region directs and converges surrounding air.

8. The heat dissipation fan as claimed in claim 1, wherein a material of the hub is plastic or metal.

9. The heat dissipation fan as claimed in claim 8, wherein the hub is bonded to the blades through injection molding or pressure casting.

10. The heat dissipation fan as claimed in claim 2, wherein a section thickness of each of the first blades and a section thickness of each of the second blades are less than 0.5 mm.

* * * * *